US008246189B2

(12) United States Patent
Muller et al.

(10) Patent No.: US 8,246,189 B2
(45) Date of Patent: Aug. 21, 2012

(54) UNDERWATER LIGHT SYSTEM

(75) Inventors: Michael Muller, Studio City, CA (US); Erik Hjermstad, San Marcos, CA (US); Lee Peterson, San Diego, CA (US)

(73) Assignee: Whitemike, LLC, Los Angeles, CA (US)

( * ) Notice: Subject to any disclaimer, the term of this patent is extended or adjusted under 35 U.S.C. 154(b) by 370 days.

(21) Appl. No.: 12/609,496

(22) Filed: Oct. 30, 2009

(65) Prior Publication Data

US 2010/0246195 A1 Sep. 30, 2010

Related U.S. Application Data

(60) Provisional application No. 61/163,739, filed on Mar. 26, 2009.

(51) Int. Cl.
*F21V 31/00* (2006.01)
*F21V 17/00* (2006.01)

(52) U.S. Cl. ..... 362/101; 362/267

(58) Field of Classification Search ..... 362/101, 362/267, 375, 477; 114/315
See application file for complete search history.

(56) References Cited

U.S. PATENT DOCUMENTS

| | | | | |
|---|---|---|---|---|
| 4,113,137 | A | 9/1978 | Wind | |
| 4,276,580 | A * | 6/1981 | Rogers | 362/22 |
| 4,771,299 | A | 9/1988 | Gell, Jr. | |
| 4,853,722 | A | 8/1989 | Gell, Jr. | |
| 6,271,629 | B1 * | 8/2001 | Pace et al. | 315/56 |
| 6,474,834 | B2 | 11/2002 | Lai | |
| 7,249,867 | B2 * | 7/2007 | Hagen et al. | 362/267 |
| 7,591,564 | B1 * | 9/2009 | Ball et al. | 362/101 |
| 2004/0100793 | A1 | 5/2004 | Monitto | |
| 2005/0041427 | A1 * | 2/2005 | Esser | 362/267 |
| 2006/0002105 | A1 * | 1/2006 | Hinojosa | 362/101 |
| 2009/0109675 | A1 * | 4/2009 | Navarro Alvarez | 362/249.02 |

* cited by examiner

*Primary Examiner* — Peggy A. Neils
(74) *Attorney, Agent, or Firm* — Fitch, Even, Tabin & Flannery, LLP

(57) ABSTRACT

An underwater light system includes a waterproof housing for enclosing a light source. According to one embodiment the housing has a removable, transparent, acrylic dome which seats onto a metal base. Strobe light electric circuitry and one or more light bulbs or other light sources are disposed inside the housing. The housing is configured to be vacuum sealed, and the removable nature of the dome and metal base permits convenient access to the light sources for replacement or other maintenance. An external electrical cable provides power via an external power source for the light sources while in use underwater. The power source is disposed apart from the housing, and the external power cable remains attached to the housing while underwater and in use.

7 Claims, 4 Drawing Sheets

UNDERWATER LIGHT SYSTEM

CROSS REFERENCE TO RELATED APPLICATIONS

This application claims the benefit of U.S. Provisional Application No. 61/163,739, filed Mar. 26, 2009, which such application is incorporated herein by reference.

FIELD OF INVENTION

This relates to an underwater light system for use in providing lighting for various uses in the water, such as for example, underwater photography.

BACKGROUND

Underwater photography is a specialized undertaking that requires specialized equipment. One challenge is the loss of color and contrast when relying upon natural sunlight. The longer wavelengths of sunlight are absorbed quickly by the surrounding water, so objects appear blue-green in color to the human eye and cameras. This loss and shift of color occurs both with increasing water depth as well as horizontal distance between the camera and subject. Thus subjects that are further away from the camera can appear generally colorless but with a blue tint. This effect is true even in apparently clear ocean water.

One method of addressing this problem is to place the camera as close as possible to the subject and the water's surface thus minimizing the loss of color. Another method, which can provide a greater opportunity for improved image color and quality, involves the use of flash or strobe lighting to restore color that otherwise would be lost. The use of a flash or strobe light is often viewed as a difficult aspect of underwater photography. As mentioned color is absorbed as light travels through water. The deeper one dives, the less reds, oranges and yellow colors from the natural light remain visible. A strobe light replaces that color, as well as helps to provide shadow and texture.

Another complication is what is known as "backscatter" which occurs when the light from an artificial light source reflects particles in the water. Even seemingly clear ocean water often contains large quantities of this particulate which usually is not readily seen by the human eye. One method of addressing this problem is to locate the light source away from the axis of the camera lens. Thus oriented the light normally will not reflect the water particles located in front of the lens in a direction toward the lens, but the light will still illuminate the subject. Various types of attachments are used to make off-camera strobes easier to use.

Thus while strobe lights provide a valuable source of light when underwater, many conventional lights have limitations. Because of the rapid loss of light as a function of distance underwater, strobes have a limited range. Moreover, maintaining a relatively small physical size of strobe light units is important, since underwater portability is often a requirement in this environment. Given the above-described challenges and limitations, there remains a need for improved equipment for underwater lighting.

SUMMARY OF THE ILLUSTRATED EMBODIMENTS

Broadly speaking, embodiments of the invention relate to an underwater light system and housing for use in providing lighting for various uses in the water, such as for example, underwater photography. The housing includes a proximate housing portion, which in one embodiment is a removable, transparent, acrylic dome and which seats onto a distal housing portion, which in this embodiment is a metal base. Strobe light electric circuitry and one or more light bulbs (or other light sources) are placed in a housing interior that is formed by the metal base and dome. The housing is waterproof and configured so that the housing interior can be vacuum sealed. The removable nature of the dome and metal base permits convenient access to the light bulbs for their replacement or other maintenance. An external electrical cable provides power from a power source for the light bulbs while in use underwater. The power source is disposed on or above the water surface, and the external power cable extends from the power source and is attached to the housing while underwater and in use. The use of the external power source and external cable provides more power for brighter lighting during use as compared with conventional underwater strobes and housings.

In one aspect, an apparatus for use underwater by a user and for use with an air conduit, an electrical cable, and a light source is provided. The apparatus comprises a housing defining a first port and a second port. At least a portion of the housing is constructed of a material that is transparent, and the housing is sized for manual carrying by the user. The light source is disposed within the housing and configured so that light from it can travel through the transparent material. The housing defines a housing interior that is configured for fluid communication with the air conduit to permit air to flow from the housing interior through the first port and through the air conduit. The light source is configured to receive electrical power via the electrical cable so that the electrical power can flow through the second port when the housing is disposed underwater. At least a portion of the electrical cable is disposed external to the housing when the housing is disposed underwater. The housing is configured to hold a vacuum within the housing interior when the housing is disposed underwater and when the light source receives the electrical power via the electrical cable.

In another aspect, a first fitting is coupled to the first port and configured for removable coupling to the air conduit. The first fitting is further configured to permit the air to flow from the housing interior into the air conduit when the air conduit is coupled to the first fitting. The first fitting is further configured to inhibit the passage of the air and the water into the housing interior when the air conduit is not coupled to the first fitting.

In another aspect, a second fitting is coupled to the second port and configured so that the electrical power can flow through the second fitting. The second fitting is further configured so that the electrical cable can be electrically disconnected from the light source and can be electrically connected to the light source. The second fitting is further configured to inhibit the passage of the water into the housing interior.

In yet another aspect, the housing comprises a proximate housing portion and a distal housing portion. The proximate and distal housing portions are configured to be removably secured to one another. At least a portion of the proximate housing portion is constructed of the material that is transparent.

In an alternative embodiment, a method of providing light underwater is provided. An air conduit is attached to a housing defining a first port and further defining a housing interior that is in fluid communication with the air conduit. The housing is sized for manual carrying by a user, and at least a portion of the housing is constructed of a transparent material. Air is drawn from the housing interior through the first port and through the air conduit so that a vacuum is created in the housing interior. The housing is submerged underwater while the vacuum is in the housing interior. Electrical power is applied from a power source through an electrical cable to a light source disposed within the housing interior so that light travels from the light source through the transparent material when the housing is disposed under the water. The power source and at least a portion of the electrical cable are disposed outside of the housing.

In another aspect, the air conduit is detached from the housing after the drawing of the air from the housing interior. The vacuum is maintained in the housing interior after the detaching of the air conduit.

In yet another aspect, the housing further defines a second port. The electrical cable is electrically connected to a fitting attached to the second port prior to the applying of the electrical power from the power source through the electrical cable to the light source. The applying of the electrical power from the power source includes applying the electrical power so that it flows through the fitting and the second port of the housing.

There are additional aspects to the present inventions. It should therefore be understood that the preceding is merely a brief summary of some embodiments and aspects of the present inventions. Additional embodiments and aspects are referenced below. It should further be understood that numerous changes to the disclosed embodiments can be made without departing from the spirit or scope of the inventions. The preceding summary therefore is not meant to limit the scope of the inventions. Rather, the scope of the inventions is to be determined by appended claims and their equivalents.

BRIEF DESCRIPTION OF THE DRAWINGS

These and/or other aspects and advantages of the present invention will become apparent and more readily appreciated from the following description of certain embodiments, taken in conjunction with the accompanying drawings of which.

DETAILED DESCRIPTION

Figure 1:
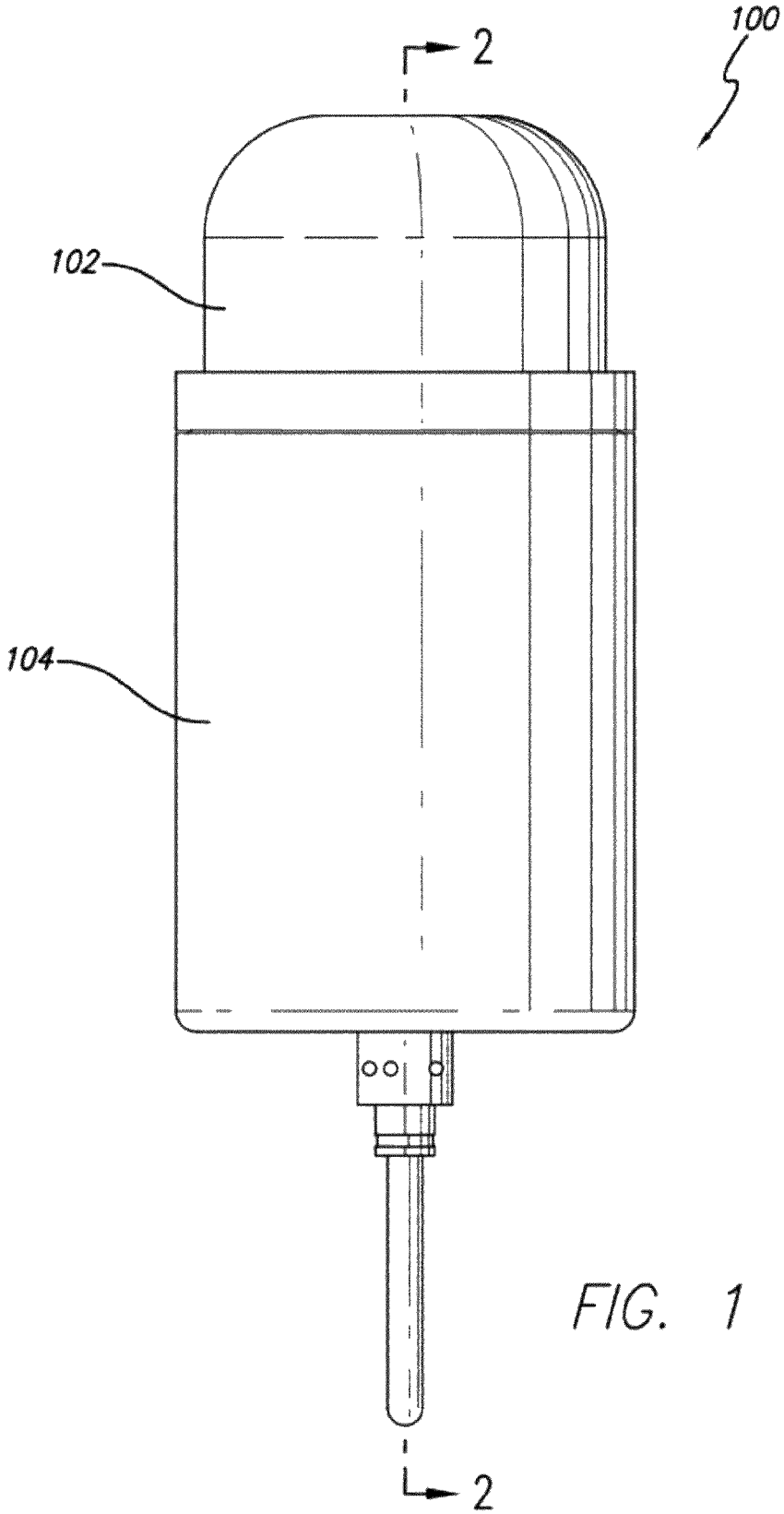
FIG. 1 is a side elevation view of a strobe light housing for use underwater in accordance with one embodiment of the invention.

The following description is of the best mode presently contemplated for carrying out the invention. Reference will be made in detail to embodiments of the present invention, examples of which are illustrated in the accompanying drawings, wherein like reference numerals refer to like elements throughout. It is understood that other embodiments may be used, and structural and operational changes may be made without departing from the scope of the present invention.

According to one embodiment of the invention, an underwater strobe light system for use in underwater photography is provided. The system includes a waterproof housing, electrical circuitry disposed within the housing, and a light source that is disposed within the housing and connected to the electrical circuitry. The housing includes a removable, transparent, acrylic dome which seats onto a metal base. The electric circuitry and the light source (such as for example, one or more light bulbs) are disposed in a housing interior that is formed by the base and dome. The housing is configured so that its interior can be vacuum sealed. Because the dome is removable from the base, convenient access to the light bulbs for their replacement or other maintenance is provided.

Before going into the water, a user assembles the dome onto the base. An external hose or conduit is attached to a bottom of the base using a conventional, quick-disconnect fitting. The other end of the hose is attached to a manual or electric vacuum pump. When a vacuum in the housing interior is achieved using the vacuum pump, the hose is disconnected prior to going into the water.

According to this embodiment, the metal base further includes an electrical fitting for attachment to an external electrical cable that provides power via a power source for the light source while in use underwater. The power source, such as for example a battery or an electro-mechanical generator, remains disposed apart from the housing (including locations that could be underwater or on or above the water surface), and the power cable remains attached to the housing while underwater and in use. The use of the external power source and external electrical cable provides more power for brighter lighting during use, as compared with conventional underwater strobe light housings that enclose batteries within the housings.

FIG. 1 shows an underwater light housing 100 according to one embodiment of the invention. The housing 100 is waterproof and generally cylindrical in shape and is comprised of a proximate housing portion 102 and a distal housing portion 104. The housing 100 is sized so that one user can manually carry it while in the water or while outside of the water. In the illustrated embodiment, the diameter of the housing 100 is about 4 inches, the axial length of the housing 100 is about 8.75 inches, and the weight of the housing 100 (excluding internal electrical circuitry and other components not shown in FIG. 1) is about 3.5 pounds. However alternative embodiments may have different dimensions, weights and configurations.

The proximate housing portion 102 is a dome-type structure which is constructed of a material, such as for example an acrylic material, that is transparent thus allowing light from a light source, such as a light bulb (not shown in FIG. 1), to be transmitted through the material. The distal housing portion 104 is generally cylindrical in shape and is constructed of metal. These proximate and distal housing portions 102, 104 are configured for cooperative engagement so that they can be removably secured to one another, and so that when they are disassembled convenient access to the light source is provided for replacement or other maintenance.

Figure 2:
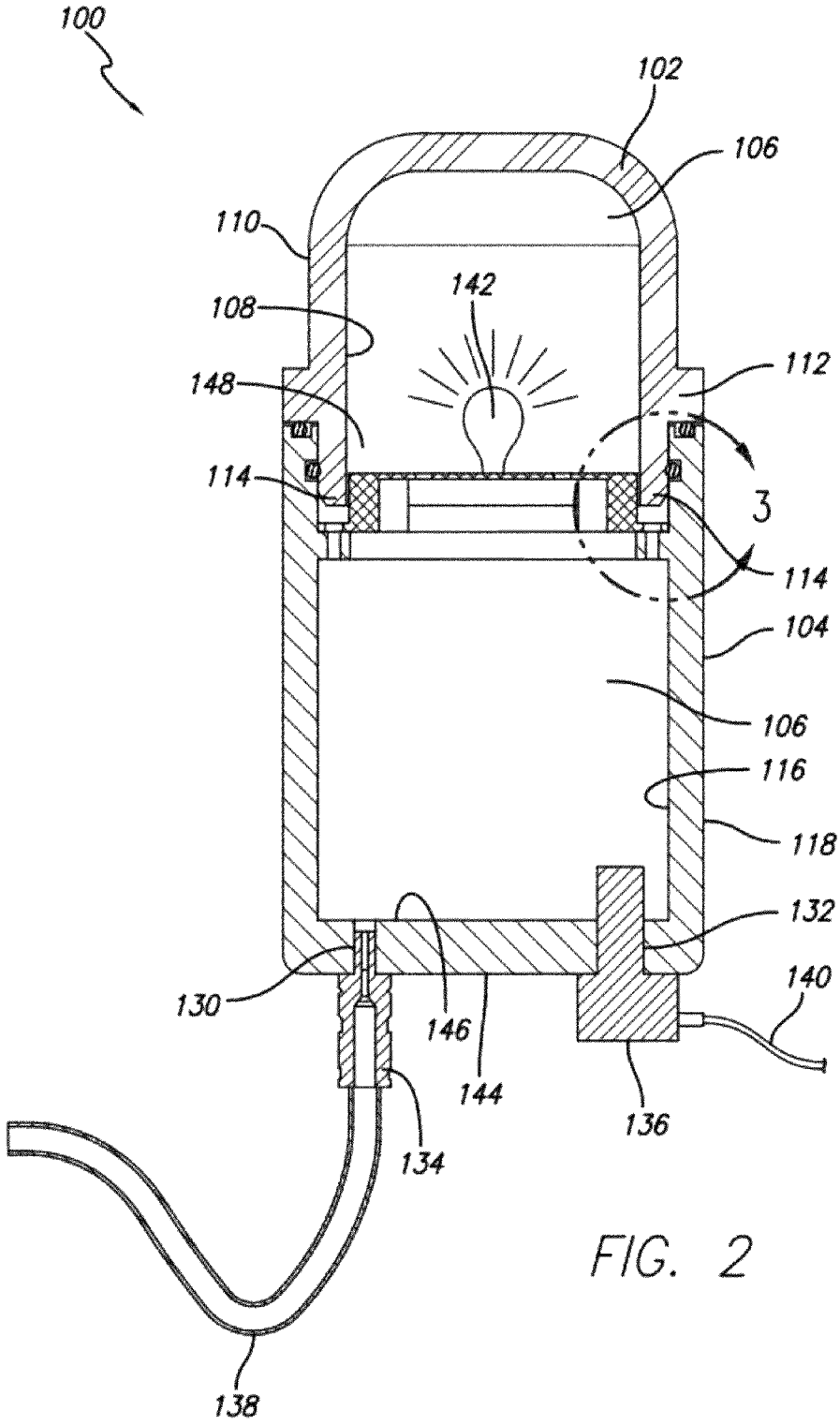
FIG. 2 is a cross-sectional view along the lines 2-2 of FIG. 1 of the strobe light housing of FIG. 1.
Figure 3:
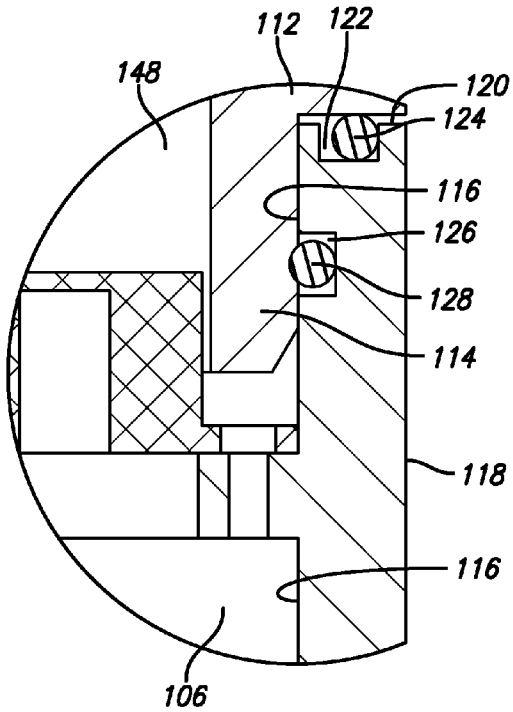
FIG. 3 is an enlarged portion of the cross-sectional view of FIG. 2 defined by broken line 3 of FIG. 2.

Referring now to FIGS. 2 and 3, the proximate housing portion 102 mates within the distal housing portion 104 in a friction-fit manner thereby defining a housing interior 106 that extends within both of the proximate and distal housing portions 102, 104. As explained in more detail below, the housing 100 is configured so that a vacuum can be maintained in the housing interior 106 when the housing 100 is underwater.

The proximate housing portion 102 has an inner surface 108, an outer surface 110, a flange 112 extending radially away from the outer surface 110, and a generally cylindrically-shaped mating portion 114 or piston. The distal housing portion 104 has an inner wall 116 or sidewall that is generally cylindrical in shape, an outer wall 118 that also is generally cylindrical in shape, a closed end 144 having an end wall 146, an open end 148, and a rim or proximate wall 120 that is disposed at the open end 148 and that connects the inner and outer walls 116, 118. The rim or proximate wall 120 defines an upper groove 122 for receiving a first mechanical seal 124. The inner wall 116 similarly defines an inner groove 126 disposed adjacent to the proximate wall 120 for receiving a second mechanical seal 128. In the illustrated embodiment, the first and second mechanical seals 124, 128 are O-rings, although other embodiments may include other types of mechanical seals.

When the proximate and distal housing portions 102, 104 are secured to one another, the mating portion 114 of the proximate housing portion 102 extends into the open end 148 of the distal housing portion 104 and is disposed within the distal housing portion 104 in a slide-fit reception configuration. The mating portion 114 abuts the inner wall 116 of the distal housing portion 104 as well as the second mechanical seal 128 thereby providing an air tight and water tight seal at this location. Similarly, the flange 112 of the proximate housing portion 102 abuts the rim or proximate wall 120 of the distal housing portion 104 as well as the first mechanical seal 124 thereby providing another air tight and water tight seal at this location when the proximate and distal housing portions 102, 104 are secured to one another. It should be noted that while the illustrated embodiment involves the use of a flange of one housing portion seating against a rim and mechanical seal of another housing portion, alternative embodiments need not use a flange. Rather alternative embodiments can include a seating surface of one housing portion seating against another seating surface of another housing portion with a mechanical seal disposed between these seating surfaces.

Still referring to FIGS. 2 and 3, this arrangement using two mechanical seals provides a double seal or barrier for the housing interior 106 for maintaining a vacuum and keeping water out. Moreover this arrangement involves three different pressures acting on the housing 100 when underwater. Water pressure acts on the housing exterior and the exterior side of the first mechanical seal 124. Atmospheric pressure acts in the spacing between the two mechanical seals 124, 128. And vacuum pressure acts on the housing interior 106 and on the inside of the second mechanical seal 128. Operating with a vacuum in the housing interior 106 is believed to be advantageous in that it is believed to result in a reduction in harmful heat buildup and the ensuing increase in air pressure resulting from the heat generated by the light source and electrical circuitry. The vacuum also allows for a reduced size of the overall housing diameter as well as a reduction in weight compared with many conventional strobe light housings. The vacuum provides a force whereby the proximate housing portion 102 is forced against the proximate wall 120 of the distal housing portion 104 thereby compressing the first mechanical seal 124 and enhancing the sealing characteristics at this location.

Still referring to FIGS. 2 and 3, the end wall 146 of the distal housing portion 104 defines a first port 130 and a second port 132, each of which leads from the exterior of the housing 100 into the housing interior 106. A hose fitting 134 is connected to the distal housing portion 104 by insertion into the first port 130. The hose fitting 134 is a so-called quick-disconnect type that is configured to permit one end of an air conduit or hose 138 to connect to and disconnect from the hose fitting 134. A cap or plug (not shown) is placed over the external end of the hose fitting 134 when the hose 138 is not connected thus enhancing the waterproof characteristics of the fitting 134. At the opposite end of the hose 138 is attached an air pump (not shown) for use in drawing air out of the housing interior 106 via the hose 138. Thus the hose fitting 134 is configured to permit the air to flow from the housing interior 106 through the hose fitting 134 and into the hose 138 thereby drawing a vacuum in the housing interior 106. The hose 138 can then be disconnected from the hose fitting 134, and the cap or plug placed over the external end of the fitting 134 thus preventing air and water from entering the housing interior 106 and thereby maintaining the vacuum. In one embodiment, the hose fitting 134 is a Swagelok® quick connect fitting, model number SS-QM2-B-1PM, manufactured by Swagelok Company of Solon, Ohio; however alternative embodiments may use other types of fittings.

An electrical fitting 136 is a connector-type fitting that is attached to the distal housing portion 104 by insertion into the second port 132. The electrical fitting 136 is configured to be electrically coupled to a light source 142 disposed within the housing interior 106 via internal electrical circuitry (not shown) also disposed within the housing interior 106. The electrical fitting 136 is further configured to permit an external electrical cable 140 to electrically connect to the fitting 136 so that electrical power can flow from a power source (not shown) located external to the housing 100 through the electrical cable 140, the electrical fitting 136, the internal electrical circuitry and to the light source 142 while the housing 100 is located underwater. Moreover the electrical fitting 136 inhibits the passage of water and air into the housing interior 106 regardless of whether or not the fitting 136 is connected to the electrical cable 140. In one embodiment, the electrical fitting 136 is a Sea Con® wet electrical connector, model number FAWM-P-BC-R/A, manufactured by Brantner & Associates, Inc., of El Cajon, Calif.; however alternative embodiments may use other types of fittings. As previously mentioned the power source is disposed external to the housing 100. The power source can be in a waterproof container or envelope and located underwater or at the water surface. Alternatively the power source can be located on a boat or on land where a waterproof container or envelope may not be necessary.

Figure 3A:
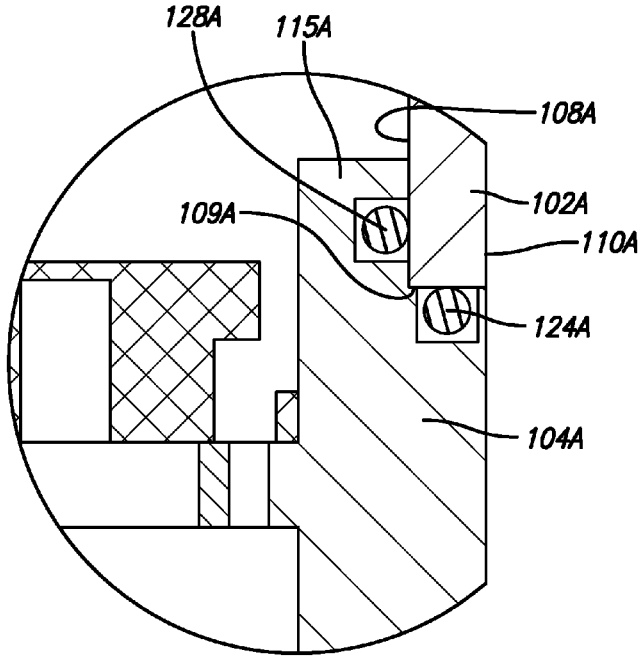
FIG. 3A is an enlarged portion of a cross-sectional view of an alternative embodiment.

FIG. 3A illustrates an alternative embodiment. According to this embodiment a proximate housing portion 102A and a distal housing portion 104A are configured to be removably secured to one another. At least a portion of the proximate housing portion 102A is constructed of a material that is transparent. The proximate housing portion 102A has an inner wall 108A, an outer wall 110A and a proximate wall 109A connecting the inner and outer walls 108A, 110A. The distal housing portion 104A includes a mating portion 115A disposed within the proximate housing portion 102A when it is removably secured to the distal housing portion 104A. Also when the proximate and distal housing portions 102A, 104A are secured to one another the distal housing portion 104A abuts a first mechanical seal 124A and the proximate wall 109A of the proximate housing portion 102A, so that the first mechanical seal 124A is disposed between the distal housing portion 104A and the proximate wall 109A. The mating portion 115A of the distal housing portion 104A abuts a second mechanical seal 128A and the proximate housing portion inner wall 108A so that the second mechanical seal 128A is disposed between the mating portion 115A and the inner wall 108A of the proximate housing portion 102A when the proximate and distal housing portions 102A, 104A are secured to one another.

Figure 4:
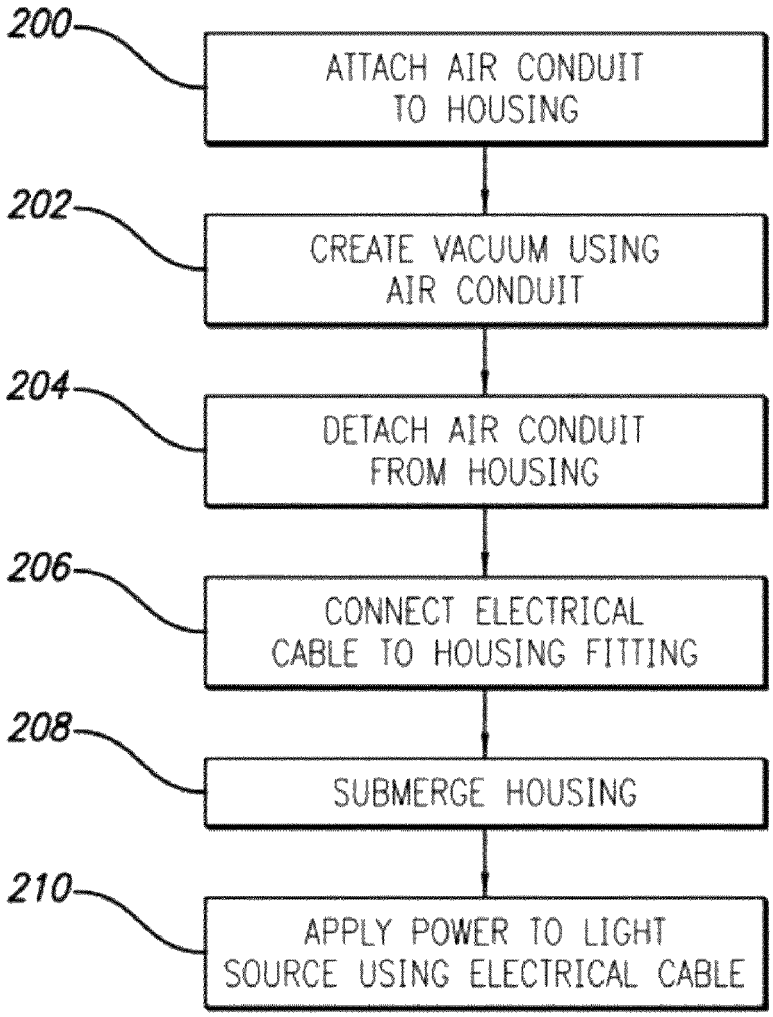
FIG. 4 is a simplified process flow diagram for a method of providing light for use underwater.

FIG. 4 illustrates a simplified process flow for a method of providing light for use underwater according to another embodiment of the invention. A hose or an air conduit is attached to a housing defining a housing interior so that the housing interior is in fluid communication with the air conduit. (Step 200) The housing is sized for manual carrying by a user and at least a portion of the housing is constructed of a transparent material. Then air is drawn from the housing interior through a first port defined by the housing and through the air conduit so that a vacuum is created in the housing interior. (Step 202) The air conduit is detached from the housing after the drawing of the air from the housing interior, while maintaining the vacuum in the housing interior. (Step 204) (For embodiments that use a hose fitting of a certain design which is secured into the first port, a cap or plug is placed onto the external end of the hose fitting after the air conduit is detached.)

An electrical cable is electrically connected to a fitting attached to a second port defined by the housing. (Step 206) The housing is submerged underwater while the vacuum is maintained in the housing interior. (Step 208) Electrical power is applied from a power source through the electrical cable to a light source disposed within the housing interior so that the power flows through the fitting and the second port of the housing. (Step 210) The power source and at least a portion of the electrical cable are disposed outside of the housing. This application of the electrical power causes the light source to emit light which travels from the light source through the transparent material when the housing is under the water.

In view of the above, it will be appreciated that certain embodiments of the invention overcome many of the long-standing problems in the art by providing an improved underwater light system. According to one embodiment a housing includes a removable, transparent, acrylic dome which seats onto a metal base. Strobe light electric circuitry and one or more light bulbs (or other light sources) are placed in a housing interior that is formed by the dome and metal base. The housing is configured so that its interior can be vacuum sealed. The removable nature of the dome and metal base permits convenient access to the light bulbs for their replacement or other maintenance. An external electrical cable provides power via a power source for the light bulbs while in use underwater. The power source is located on or above the water surface, and the external power cable remains attached to the housing while underwater and in use. The use of the external power source and external cable allows for a larger and more powerful power source for brighter lighting during use, as compared with conventional underwater strobe light housings.

While the description above refers to particular embodiments of the present invention, it will be understood that many modifications may be made without departing from the spirit thereof. The claims are intended to cover such modifications as would fall within the true scope and spirit of the present invention. The presently disclosed embodiments are therefore to be considered in all respects as illustrative and not restrictive, the scope of the invention being indicated by the claims rather than the foregoing description, and all changes which come within the meaning and range of equivalency of the claims are therefore intended to be embraced therein.

What is claimed is:

1. An apparatus for use underwater by a user and for use with an air conduit, an electrical cable, and a light source, the apparatus comprising:

a housing defining a first port and a second port; and a mechanical seal, wherein the housing comprises a proximate housing portion and a distal housing portion, wherein the proximate and distal housing portions are configured to be removably secured to one another, and wherein at least a portion of the proximate housing portion is constructed of a material that is transparent, wherein the light source is disposed within the housing and configured so that light from the light source can travel through the transparent material, and wherein the housing is sized for manual carrying by the user, wherein the housing defines a housing interior that is configured for fluid communication with the air conduit to permit air to flow from the housing interior through the first port and through the air conduit, wherein the light source is configured to receive electrical power via the electrical cable so that the electrical power can flow through the second port when the housing is disposed underwater, and wherein at least a portion of the electrical cable is disposed external to the housing when the housing is disposed underwater, wherein the housing is configured to hold a vacuum within the housing interior when the housing is disposed underwater and when the light source receives the electrical power via the electrical cable, wherein the distal housing portion has an inner wall, an outer wall and a proximate wall connecting the inner and outer walls, wherein the proximate housing portion abuts the mechanical seal and the proximate wall of the distal housing portion when the proximate and distal housing portions are secured to one another, and wherein the mechanical seal is disposed between the proximate housing portion and the proximate wall of the distal housing portion when the proximate and distal housing portions are secured to one another.

2. An apparatus for use underwater by a user and for use with an air conduit, an electrical cable, and a light source, the apparatus comprising:

a housing defining a first port and a second port; and a mechanical seal, wherein the housing comprises a proximate housing portion and a distal housing portion, wherein the proximate and distal housing portions are configured to be removably secured to one another, and wherein at least a portion of the proximate housing portion is constructed of a material that is transparent, wherein the light source is disposed within the housing and configured so that light from the light source can travel through the transparent material, and wherein the housing is sized for manual carrying by the user, wherein the housing defines a housing interior that is configured for fluid communication with the air conduit to permit air to flow from the housing interior through the first port and through the air conduit, wherein the light source is configured to receive electrical power via the electrical cable so that the electrical power can flow through the second port when the housing is disposed underwater, and wherein at least a portion of the electrical cable is disposed external to the housing when the housing is disposed underwater, wherein the housing is configured to hold a vacuum within the housing interior when the housing is disposed underwater and when the light source receives the electrical power via the electrical cable, wherein the proximate housing portion has an inner wall, an outer wall and a proximate wall connecting the inner and outer walls, wherein the distal housing portion abuts the mechanical seal and the proximate wall of the proximate housing portion when the proximate and distal housing portions are secured to one another, and wherein the mechanical seal is disposed between the distal housing portion and the proximate wall of the proximate housing portion when the proximate and distal housing portions are secured to one another.

3. An apparatus for use underwater by a user and for use with an air conduit, an electrical cable, and a light source, the apparatus comprising:

a housing defining a first port and a second port; and a mechanical seal, wherein the housing comprises a proximate housing portion and a distal housing portion, wherein the proximate and distal housing portions are configured to be removably secured to one another, and wherein at least a portion of the proximate housing portion is constructed of a material that is transparent, wherein the light source is disposed within the housing and configured so that light from the light source can travel through the transparent material, and wherein the housing is sized for manual carrying by the user, wherein the housing defines a housing interior that is configured for fluid communication with the air conduit to permit air to flow from the housing interior through the first port and through the air conduit, wherein the light source is configured to receive electrical power via the electrical cable so that the electrical power can flow through the second port when the housing is disposed underwater, and wherein at least a portion of the electrical cable is disposed external to the housing when the housing is disposed underwater, wherein the housing is configured to hold a vacuum within the housing interior when the housing is disposed underwater and when the light source receives the electrical power via the electrical cable.

wherein the distal housing portion has an inner wall, an outer wall and a proximate wall connecting the inner and outer walls, wherein the proximate housing portion includes a mating portion disposed within the distal housing portion and abutting the mechanical seal and the distal housing portion inner wall when the proximate and distal housing portions are secured to one another, and wherein the mechanical seal is disposed between the mating portion of the proximate housing portion and the inner wall of the distal housing portion when the proximate and distal housing portions are secured to one another.

4. An apparatus for use underwater by a user and for use with an air conduit, an electrical cable, and a light source, the apparatus comprising:

a housing defining a first port and a second port; and a mechanical seal, wherein the housing comprises a proximate housing portion and a distal housing portion, wherein the proximate and distal housing portions are configured to be removably secured to one another, and wherein at least a portion of the proximate housing portion is constructed of a material that is transparent, wherein the light source is disposed within the housing and configured so that light from the light source can travel through the transparent material, and wherein the housing is sized for manual carrying by the user, wherein the housing defines a housing interior that is configured for fluid communication with the air conduit to permit air to flow from the housing interior through the first port and through the air conduit, wherein the light source is configured to receive electrical power via the electrical cable so that the electrical power can flow through the second port when the housing is disposed underwater, and wherein at least a portion of the electrical cable is disposed external to the housing when the housing is disposed underwater, and wherein the housing is configured to hold a vacuum within the housing interior when the housing is disposed underwater and when the light source receives the electrical power via the electrical cable, wherein the proximate housing portion has an inner wall, an outer wall and a proximate wall connecting the inner and outer walls, wherein the distal housing portion includes a mating portion disposed within the proximate housing portion and abutting the mechanical seal and the proximate housing portion inner wall when the proximate and distal housing portions are secured to one another, and wherein the mechanical seal is disposed between the mating portion of the distal housing portion and the inner wall of the proximate housing portion when the proximate and distal housing portions are secured to one another.

5. An apparatus for use underwater by a user and for use with an air conduit, an electrical cable, and a light source, the apparatus comprising:

a housing defining a first port and a second port; and a first mechanical seal and a second mechanical seal, wherein the housing comprises a proximate housing portion and a distal housing portion, wherein the proximate and distal housing portions are configured to be removably secured to one another, and wherein at least a portion of the proximate housing portion is constructed of a material that is transparent, wherein the light source is disposed within the housing and configured so that light from the light source can travel through the transparent material, and wherein the housing is sized for manual carrying by the user, wherein the housing defines a housing interior that is configured for fluid communication with the air conduit to permit air to flow from the housing interior through the first port and through the air conduit, wherein the light source is configured to receive electrical power via the electrical cable so that the electrical power can flow through the second port when the housing is disposed underwater, and wherein at least a portion of the electrical cable is disposed external to the housing when the housing is disposed underwater, wherein the housing is configured to hold a vacuum within the housing interior when the housing is disposed underwater and when the light source receives the electrical power via the electrical cable, wherein the distal housing portion has an inner wall, an outer wall and a proximate wall connecting the inner and outer walls, wherein the proximate housing portion includes an outer surface, a flange extending radially away from the outer surface and a mating portion, wherein the mating portion is disposed within the distal housing portion and abuts the distal housing portion inner wall when the proximate and distal housing portions are secured to one another, wherein the first mechanical seal is disposed between the proximate housing portion flange and the proximate wall of the distal housing portion when the proximate and distal housing portions are secured to one another, and wherein the second mechanical seal is disposed between the mating portion of the proximate housing portion and the inner wall of the distal housing portion when the proximate and distal housing portions are secured to one another.

6. An apparatus for use underwater by a user and for use with an air conduit, an electrical cable, and a light source, the apparatus comprising:

a proximate housing portion and a distal housing portion, wherein at least a portion of at least one of the proximate housing portion and the distal housing portion is constructed of a material that is transparent;

wherein the proximate and the distal housing portions are configured to be removably secured to one another and are sized for manual carrying by the user, wherein a housing interior is defined by at least one of the proximate housing portion and the distal housing portion when the proximate and distal housing portions are removably secured to one another, wherein one of the proximate housing portion and the distal housing defines a first port leading into the housing interior, wherein one of the proximate housing portion and the distal housing defines a second port leading into the housing interior, wherein the light source is disposed within the housing interior and configured so that light from the light source can travel through the transparent material when the proximate and distal housing portions are removably secured to one another;

a first fitting coupled to the first port and configured for removable coupling to the air conduit, wherein the first fitting is further configured to permit the air to flow from the housing interior into the air conduit when the air conduit is coupled to the first fitting, and wherein the first fitting is further configured to inhibit the passage of the air and the water into the housing interior when the air conduit is not coupled to the first fitting;

a second fitting coupled to the second port and configured so that the light source can receive electrical power via the electrical cable and so that the electrical power can flow through the second fitting, wherein the second fitting is further configured so that the electrical cable can be electrically disconnected from and electrically connected to the light source, and wherein the second fitting is further configured to inhibit the passage of the water into the housing interior when the proximate and distal housing portions are removably secured to one another, wherein the proximate and distal housing portions are configured to hold a vacuum within the housing interior when the proximate and distal housing portions are removably secured to one another and disposed underwater and when the light source is electrically connected to the electrical cable; and a first mechanical seal and a second mechanical seal, wherein the distal housing portion has an inner wall, an outer wall and a proximate wall connecting the inner and outer walls, wherein the proximate housing portion includes an outer surface, a flange extending radially away from the outer surface and a mating portion, wherein the mating portion is disposed within the distal housing portion and abuts the distal housing portion inner wall when the proximate and distal housing portions are removably secured to one another, wherein the first mechanical seal is disposed between the proximate housing portion flange and the proximate wall of the distal housing portion when the proximate and distal housing portions are secured to one another, and wherein the second mechanical seal is disposed between the mating portion of the proximate housing portion and the inner wall of the distal housing portion when the proximate and distal housing portions are secured to one another.

7. The apparatus of claim 6 wherein the vacuum results in a compressive force exerted on the first mechanical seal by the proximate housing portion flange and the proximate wall of the distal housing portion when the proximate and distal housing portions are removably secured to one another.

* * * * *

UNITED STATES PATENT AND TRADEMARK OFFICE

CERTIFICATE OF CORRECTION

PATENT NO. : 8,246,189 B2
APPLICATION NO. : 12/609496
DATED : August 21, 2012
INVENTOR(S) : Michael Muller et al.

It is certified that error appears in the above-identified patent and that said Letters Patent is hereby corrected as shown below:

Claim 3, column 9, line 31, delete “cable.” and insert -- cable, --.

Signed and Sealed this
Eighteenth Day of December, 2012

David J. Kappos

David J. Kappos
*Director of the United States Patent and Trademark Office*